US006695653B1

(12) United States Patent
Tomasino

(10) Patent No.: US 6,695,653 B1
(45) Date of Patent: Feb. 24, 2004

(54) NO-CRIMP ELECTRICAL CONNECTOR

(75) Inventor: René Tomasino, Doniphan, MO (US)

(73) Assignee: Swenco Products, Inc., Poplar Bluff, MO (US)

( * ) Notice: Subject to any disclaimer, the term of this patent is extended or adjusted under 35 U.S.C. 154(b) by 374 days.

(21) Appl. No.: 09/358,926

(22) Filed: Jul. 23, 1999

(51) Int. Cl.[7] ..... H01R 4/38; H01R 4/50
(52) U.S. Cl. ..... 439/805; 439/428
(58) Field of Search ..... 439/805, 784, 439/428, 427, 807

(56) References Cited

U.S. PATENT DOCUMENTS

| | | | | | |
|---|---|---|---|---|---|
| 1,039,542 | A | | 9/1912 | Kennington | 439/805 |
| 1,649,923 | A | | 11/1927 | Post | 439/807 |
| 2,056,248 | A | | 10/1936 | Buchanan | 173/303 |
| 2,724,097 | A | | 11/1955 | Matthysse | 439/805 |
| 3,790,920 | A | * | 2/1974 | Wening | 439/522 |
| 4,944,699 | A | | 7/1990 | Velke, Sr. et al. | 439/784 |
| 5,018,251 | A | | 5/1991 | Brown | 24/136 R |
| 5,228,875 | A | | 7/1993 | Swenson, Sr. | 439/784 |
| 5,487,679 | A | | 1/1996 | Quaintance | 439/428 |
| 5,695,369 | A | | 12/1997 | Swenson, Sr. | 439/784 |

FOREIGN PATENT DOCUMENTS

| | | | |
|---|---|---|---|
| CH | 237857 | 9/1945 | 439/427 |
| FR | 26368 | 6/1923 | 439/428 |
| FR | 846809 | 9/1939 | 439/428 |
| FR | 910390 | 6/1946 | 174/845 |
| GB | 879864 | 10/1961 | 439/427 |

* cited by examiner

*Primary Examiner*—P. Austin Bradley
*Assistant Examiner*—Briggitte R Hammond
(74) *Attorney, Agent, or Firm*—Jim Zegeer

(57) ABSTRACT

A no-crimp electrical connector for connecting a stranded or solid wire or conductor in the lower gauges electrical wire to an end terminal. It includes a conductive end terminal having an integral bullet-shaped wire-splaying end, and an end terminal end, a hollow, internally threaded, female connector member secured to the conductive end terminal and houses the bullet-shaped wire splaying end, and a male connector member having an externally threaded surface for threaded engagement with the internally threaded female connector member, the male connector member having a throughbore, the throughbore having a first portion which is conically shaped to define a wire clamping space for wire ends splayed by the bullet-shaped end upon relative rotation between the female and male connection members. The female connection member can be conductive and made integral with the conductive end terminal. Thumbwings for increasing torque applied by the fingers of a user can be added to the male and female connection members.

2 Claims, 3 Drawing Sheets

NO-CRIMP ELECTRICAL CONNECTOR

This invention is an improvement on the QUICK MULTIPLE ELECTRICAL CONNECTOR disclosed in Swenson U.S. Pat. No. 5,695,369 and Swenson U.S. Pat. No. 5,228,875. In the above-referenced Swenson patents, one or more connection chambers has mounted therein a shaped surface projecting into the connection chamber and a threaded surface associated therewith. A coacting clamping member is associated with the connection chamber and each clamping member has a threaded portion which is threadably engageable with the threaded surface of the connection chamber and has a complementary tapered surface which is complementary to the tapered surface on the conductive member. Stranded conductive wires are passed through the hollow clamping member and splayed on the conical or taper-shaped surface of the metal conductor. The relative rotation between the housing member and the clamping member causes the threads to reduce the distance and clamp the bare ends of the splayed wire between the conical surfaces.

According to the present invention, a no-crimp electrical connector for connecting stranded wire to an end terminal includes a conductive end terminal having an integral bullet-shaped wire splaying end and an end terminal end. The end terminal end may be a closed loop (a ring), a spade-type terminal, a clamp-type terminal such as are used on battery posts and the like. A hollow internally threaded female connector member is secured to the conductive end terminal and houses the bullet-shaped wire splaying end. A male connector member has an externally threaded surface for threaded engagement with the internally threaded female connector member, has a throughbore, the throughbore having a first portion which is conically shaped to define a wire clamping space for receiving splayed wire ends which have been splayed by the bullet-shaped end and, upon relative rotation between the male and female connector members, the splayed wire end is clamped securely to the conductive integral bullet-shaped wire splaying end and hence electrically connected to the end terminal device.

Thus, the object of the invention is to provide an improved no-crimp electrical connector for connecting stranded electrical wire to an end terminal. Solid wire in the lower gauges may also be connected using the invention.

DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
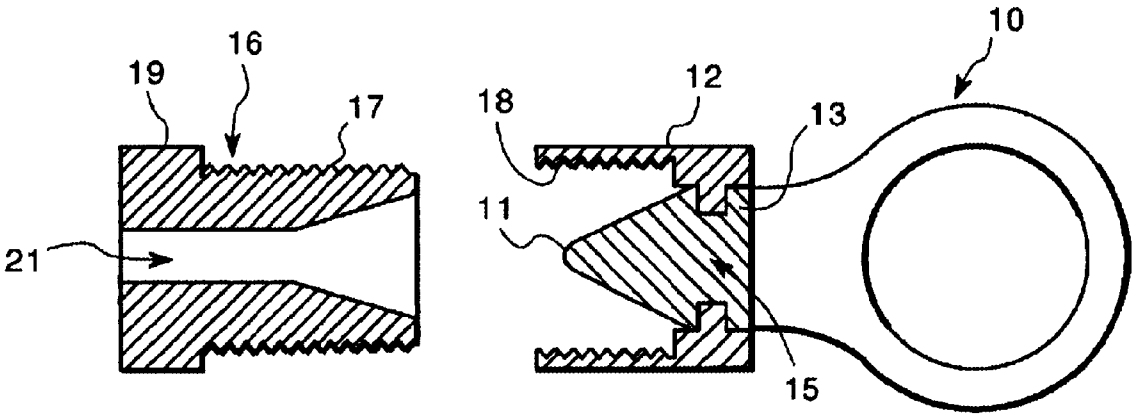
FIG. 1 is a sectional view of a no-crimp internal connector incorporating the invention.
Figure 2:
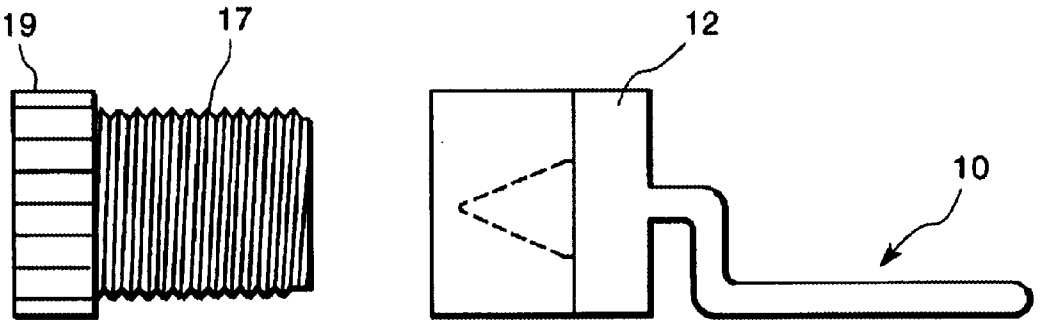
FIG. 2 is a side elevational view thereof.
Figure 3:
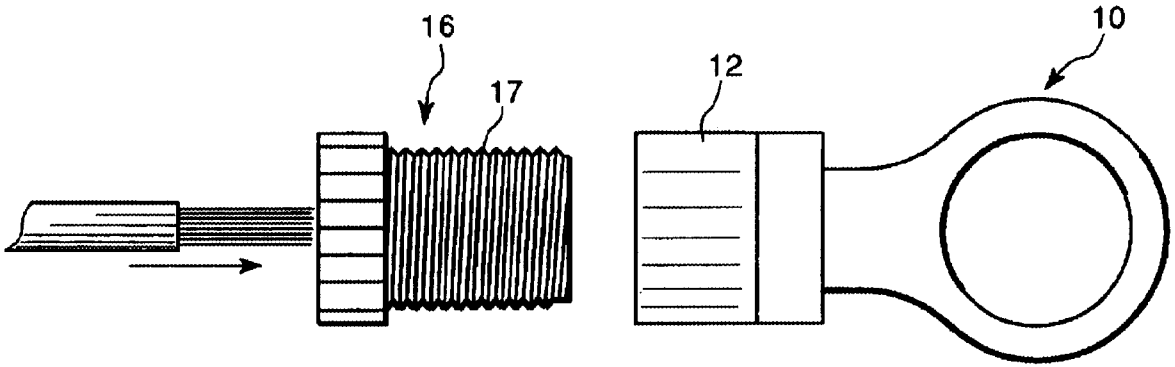
FIG. 3 is a top plan view showing a wire being entered for connecting to the end terminal.
Figure 4:
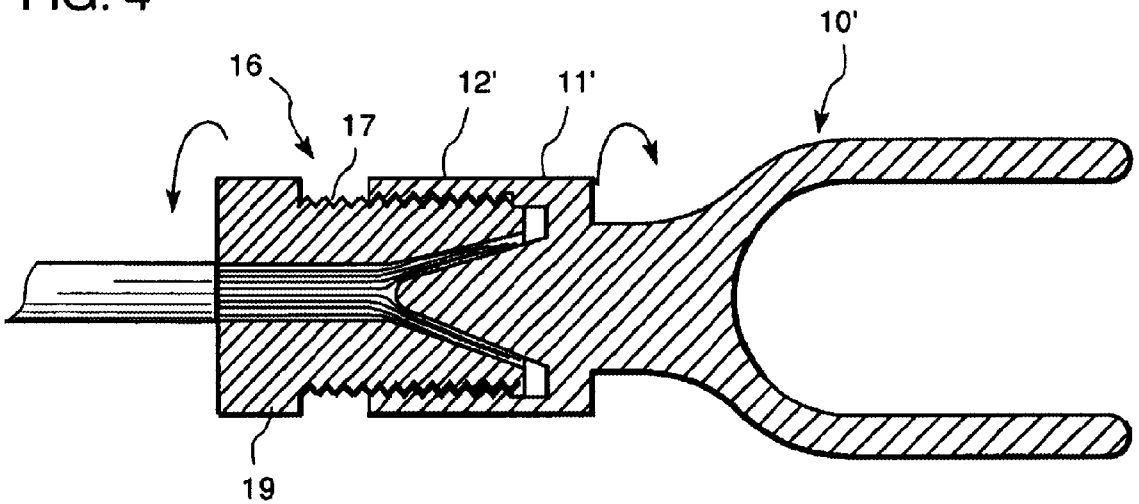
FIG. 4 is a sectional view of a further embodiment of the invention showing a wire securely clamped to the end terminal conductor.

Referring to FIG. 1, a no-crimp electrical connector incorporating the invention includes an end terminal 10 formed integrally with a bullet-shaped conductive member 11 and a hollow internally threaded female connector member 12 securely secured to the conductive end terminal by having portions thereof molded in the internal annular groove 13. As shown in FIG. 4, the female connector member 12' may be formed integrally with the conductive bullet-shaped member 11' and end terminal 10'. The exterior surface 14 of housing member 12 may be knurled or be provided without standing thumbwings which increase the twisting torque done by the user's fingers. In the embodiment shown in FIGS. 1, 2, 3 and 5, the female connection member is an insulated non-conductive member which is molded to be secured to the end connection member 16, has an externally threaded surface 17 in threaded engagement with the internally threaded female connection member surfaces 18. A knurled surface portion 19 of male connection member 16 is for gripping between the thumb and forefinger for twisting purposes when in use. Male connector member 16 may be of metal or preferably of insulating plastic.

Male connector member 16 is provided with a throughbore 21. Throughbore 21 has a portion 22 which is conically shaped to define a wire clamping space between it and the bullet-shaped member 11 for receiving wire ends which have been splayed into the space by the bullet-shaped end upon insertion of the wire in the direction indicated in FIG. 3. The splayed ends of the wires are shown in FIG. 4 in clamped condition. The clamped condition is achieved by relatively rotating the hollow internally threaded female connection member 12 relative to the rotation of the male connector member 16 in the directions indicated by the arrows in FIG. 4.

Figure 5:
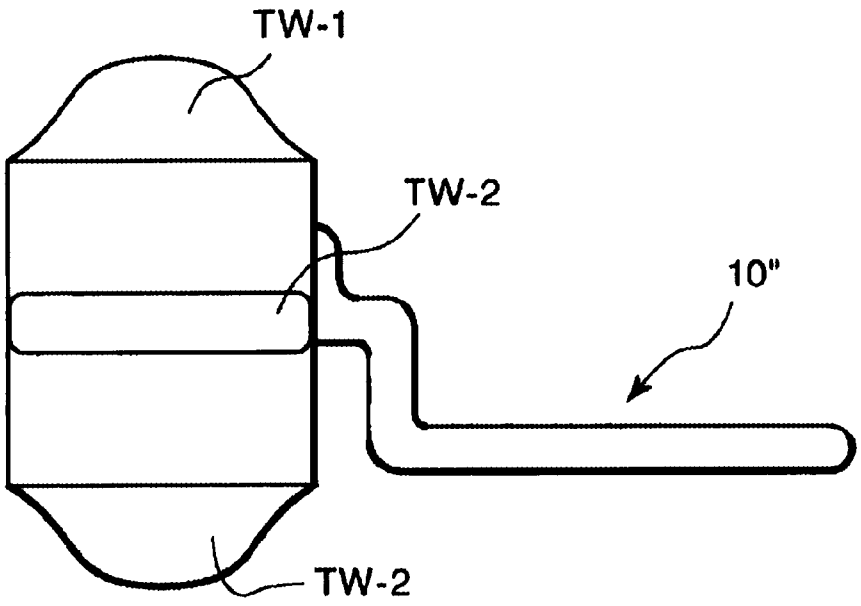
FIG. 5 is a side elevational view of a further embodiment of the invention.
Figure 5:
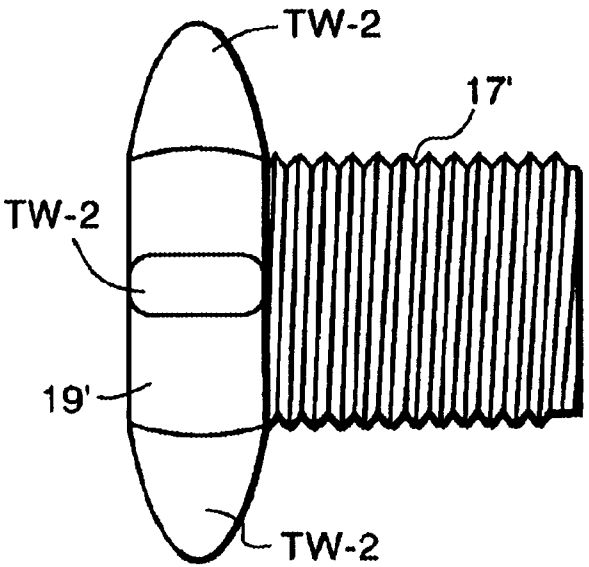

The embodiment of FIG. 5 incorporates thumbwings TW1 on the female connector member 12' and corresponding thumbwings TW2 on the male connector member 19'.

While preferred embodiments of the invention have been described and illustrated, it will be appreciated that other embodiments, adaptations and changes to the invention will be readily apparent to those skilled in the art.

What is claimed is:

1. A no-crimp electrical connector for connecting a stranded or lower gauge solid wire electrical wire to an end terminal, comprising:

a conductive end terminal having an integral bullet-shaped wire-splaying end, and an end terminal end selected from a ring and a spade, a conductive hollow, internally threaded female connector member integral with said conductive end terminal and housing said bullet-shaped wire splaying end, a male connector member having an externally threaded surface for threaded engagement with said internally threaded female connector member, said male connector member having a throughbore, said throughbore having a first portion which is conically shaped to define a wire clamping space for wire ends splayed by said bullet-shaped end upon relative rotation between said female and male connection members.

2. The no-crimp electrical connector defined in claim 1 wherein at least one of said connector members has thumbwings for increasing manually applied torque by a user.

* * * * *